US010472812B2

(12) United States Patent
Condon et al.

(10) Patent No.: US 10,472,812 B2
(45) Date of Patent: Nov. 12, 2019

(54) WATER CLOSET ASSEMBLY WITH A REMOVABLE CAP

(71) Applicant: LSP Products Group, Inc., Irving, TX (US)

(72) Inventors: Duane R. Condon, Ramona, CA (US); Daniel I. South, Dayton, NV (US); William A. Ghiglieri, Reno, NV (US)

(73) Assignee: LSP Products Group, Inc., Irving, TX (US)

( * ) Notice: Subject to any disclaimer, the term of this patent is extended or adjusted under 35 U.S.C. 154(b) by 0 days.

(21) Appl. No.: 15/817,609

(22) Filed: Nov. 20, 2017

(65) Prior Publication Data

US 2018/0142456 A1 May 24, 2018

Related U.S. Application Data

(60) Provisional application No. 62/425,828, filed on Nov. 23, 2016.

(51) Int. Cl.
*E03D 11/16* (2006.01)
*E03D 11/17* (2006.01)

(52) U.S. Cl.
CPC ..... *E03D 11/16* (2013.01); *E03D 11/17* (2013.01)

(58) Field of Classification Search
CPC ..... E03D 11/16–17
USPC ..... 138/90; 4/252.4–252.6
See application file for complete search history.

(56) References Cited

U.S. PATENT DOCUMENTS 2,596,182 A * 5/1952 Sosaya ..... E03D 11/16 138/89
4,212,486 A * 7/1980 Logsdon ..... E03D 11/16 138/96 R
4,542,642 A * 9/1985 Tagliarino ..... G01M 3/022 138/90
4,763,510 A * 8/1988 Palmer ..... G01M 3/022 138/90
5,377,361 A * 1/1995 Piskula ..... E03D 11/16 138/90
5,996,134 A * 12/1999 Senninger ..... E03D 11/16 138/96 R
6,085,363 A * 7/2000 Huber ..... E03D 11/16 138/90
6,637,464 B1 * 10/2003 Cornwall ..... E03D 11/16 138/89
6,769,291 B1 * 8/2004 Julian ..... G01M 3/022 138/90
7,350,243 B2 * 4/2008 Zahuranec ..... E03D 11/14 4/252.1
8,166,584 B2 * 5/2012 Ball ..... E03C 1/24 4/680

(Continued)

*Primary Examiner* — Erin Deery
*Assistant Examiner* — Nicholas A Ros
(74) *Attorney, Agent, or Firm* — Thomas Horstemeyer, LLP

(57) ABSTRACT

Disclosed are various embodiments for an apparatus that comprises a water closet assembly having a cylindrical body and a water closet flange. The apparatus also includes an annular shear wall that extends from the water closet assembly in a direction of a longitudinal axis of the cylindrical body. The water closet assembly can also include an annular recess. In addition, the apparatus has a wall of the annular recess that includes an outer surface of the annular shear wall and a removable cap extending from the annular shear wall.

20 Claims, 6 Drawing Sheets

(56) References Cited

U.S. PATENT DOCUMENTS

| | | | | |
|---|---|---|---|---|
| 2003/0159203 | A1* | 8/2003 | Hoover | E03D 11/16 4/252.1 |
| 2005/0138722 | A1* | 6/2005 | Humber | E03D 11/16 4/252.1 |
| 2009/0007320 | A1* | 1/2009 | Guo | E03D 11/16 4/252.6 |

* cited by examiner

WATER CLOSET ASSEMBLY WITH A REMOVABLE CAP

CROSS REFERENCE TO RELATED APPLICATIONS

This application claims the benefit of, and priority to, co-pending U.S. Provisional Patent Application No. 62/425,828 entitled "WATER CLOSET ASSEMBLY WITH A REMOVABLE CAP" filed on Nov. 23, 2016, which is incorporated herein by reference in its entirety.

BACKGROUND

A water closet flange is used to mount a toilet to the floor by connecting a toilet drain to a drain pipe in the floor. In particular, the toilet is bolted to the water closet flange and the water closet flange is connected to the floor surrounding the drain pipe.

BRIEF DESCRIPTION OF THE DRAWINGS

Many aspects of the present disclosure can be better understood with reference to the following drawings. The drawings illustrate only exemplary embodiments and are therefore not to be considered limiting of the scope of the embodiments described herein, as other equally effective embodiments are within the scope and spirit of this disclosure. The components in the drawings are not necessarily to scale, with emphasis instead being placed upon clearly illustrating the principles of the disclosure. Moreover, in the drawings, like reference numerals designate corresponding parts throughout the several views.

FIGS. 3A-3D illustrate an exemplary progression of steps for separating a removable cap from the water closet assembly shown in FIG. 1B.

DETAILED DESCRIPTION

Figure 1A:
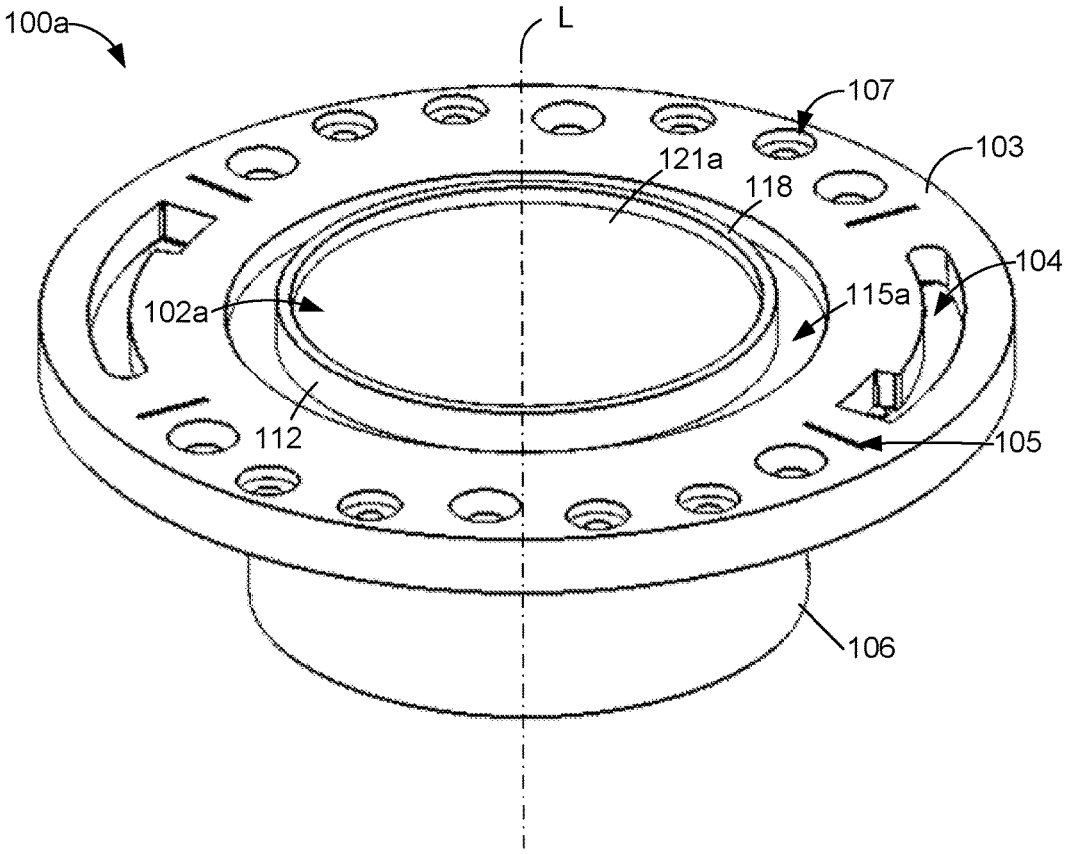
FIG. 1A is a drawing of a water closet assembly with a removable cap according to various embodiments of the present disclosure.

Turning to the drawings, a general description of embodiments of a water closet assembly with a removable cap and its components is provided, followed by a discussion of the operation of the same. With reference to FIG. 1A, shown is a perspective view of a water closet assembly 100*a* with a removable cap 102*a*. The illustrated removable cap 102*a* is one example of different types of removable caps that can be employed.

The water closet assembly 100*a* is configured to be attached to a drainage pipe in a floor. The illustrated water closet assembly 100*a* is one example of various types of water closet assemblies. In the illustrated embodiment, the water closet assembly 100*a* includes a water closet flange 103, a cylindrical body 106, and the removable cap 102*a*. The water closet flange 103 includes various arcuate apertures 104, slots 105, and perimeter apertures 107. These apertures and slots are used to attach a toilet to the water closet flange 103 and attach the water closet flange 103 to the floor surrounding the drainage pipe. The water closet flange 103 is attached to the cylindrical body 106. The cylindrical body 106 can be manufactured to meet various dimensions and thicknesses for use with various corresponding drainage pipes.

The removable cap 102*a* is configured to prevent debris from falling into the drainage pipe. The removable cap 102*a* allows a drainage system to which the water closet assembly 100*a* is attached to be pressure tested. According to an embodiment, the removable cap 102*a* can be removed from the water closet assembly 100*a* after the water closet assembly 100*a* has been installed. The removable cap 102*a* includes a raised ring 118 along a perimeter of the removable cap 102*a* and a circular platform 121*a*. The illustrated embodiment of the removable cap 102*a* is one example of various types of test caps, knockout covers, and other suitable covers for a water closet flange.

The water closet assembly 100*a* also includes an annular shear wall 112 that extends from the water closet assembly 100*a* in a direction of a longitudinal axis "L" of the cylindrical body 106. The end of the annular shear wall 112, in turn, is molded to the removable cap 102*a*. In one embodiment, the annular shear wall 112 has a thickness that is penetrable by striking or pressing a piercing instrument against the surface of the annular shear wall 112. The piercing instrument may include a flathead screwdriver, a phillips screwdriver, a chisel, a knife, and other suitable piercing instruments. In one embodiment, the piercing instrument may be driven into the annular shear wall 112 with a hammer or other blunt instrument. In some embodiments, the thickness of the annular shear wall 112 is less than a thickness of the cylindrical body 106.

In the illustrated embodiment, the water closet assembly 100*a* also includes an annular recess 115*a*. A wall of the annular recess 115*a* includes an outer surface of the annular shear wall 112. The annular recess 115*a* exposes the annular shear wall 112 and provides space for an individual to use a piercing instrument to penetrate the annular shear wall 112. In other words, the annular recess 115*a* permits access for the piercing instrument to puncture the wall of the annular shear wall 112. Specifically, the annular recess 115*a* allows an end of the piercing instrument to be positioned against the outer surface of the annular shear wall 112 and driven into the annular shear wall 113 to remove the removable cap 102*a*. For example, in some cases, positioning the piercing instrument at the proper angle against the annular shear wall 112 can enable the piercing instrument to penetrate the annular shear wall 112 with less force. In other cases, the piercing instrument may need to be positioned at a proper angle against the annular shear wall 112 to accommodate penetrating the annular shear wall 112 molded to a removable cap with a concave shape as will be described.

Figure 1B:
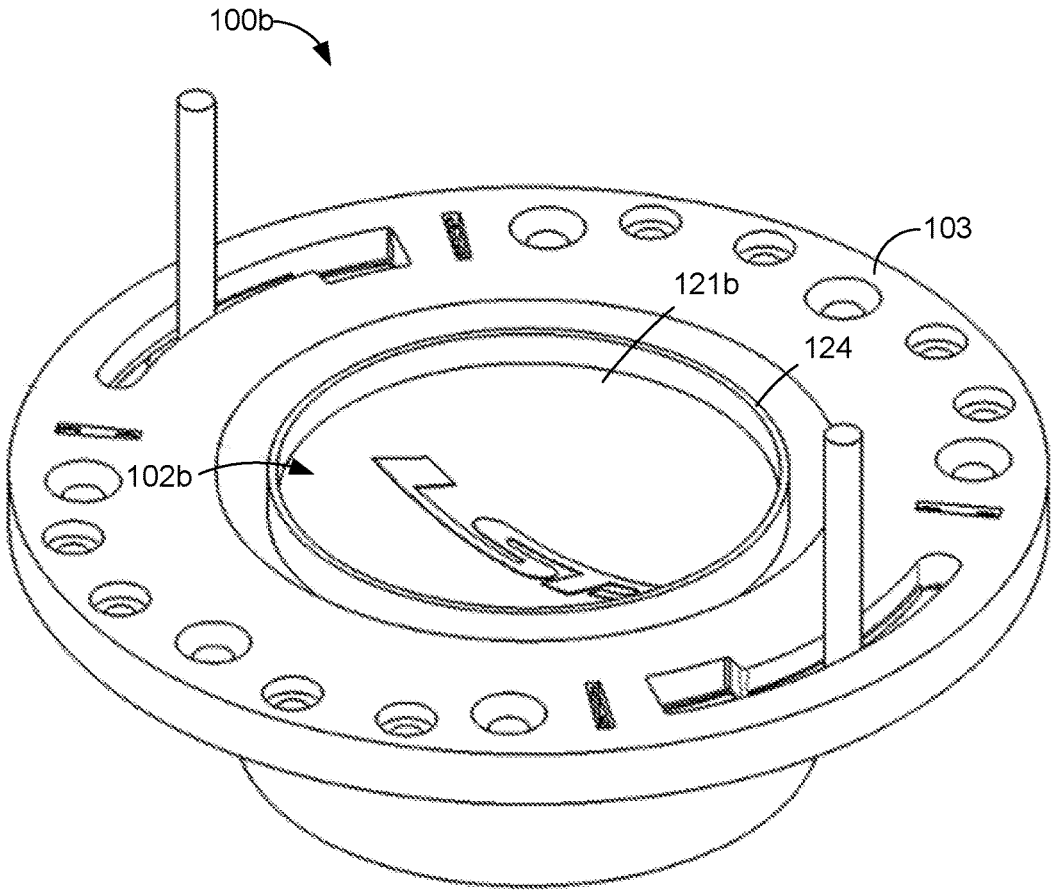
FIG. 1B is a drawing of another water closet assembly embodiment with a concave removable cap according to various embodiments of the present disclosure.

For example, FIG. 1B illustrates another water closet assembly 100*b* embodiment with a removable cap 102*b*. The removable cap 102*b* includes a circular platform 121*b* with a concave surface and a circular wall 124. In the illustrated embodiment, a top surface of the circular wall 124 is substantially level with a top surface of the water closet flange 103. In other embodiments, the top surface of the raised ring 118 may be below the top surface of the water closet flange 103. Accordingly, in such embodiments, the circular wall 124 poses less of an obstacle for objects moving or for individuals walking around or on the water closet assembly 100*b* such that it is less likely that the removable cap 102*b* can be bumped or kicked in a manner that potentially results in a partial or full removal of the removable cap 102*b*. In addition, the concave surface increases the amount of pressure the removable cap 102*b* can withstand for pressure testing the drainage pipe.

In another embodiment, the removable cap 102*b* can include a circular platform with a convex surface. For example, the convex surface of the circular platform can extend above the circular wall 124, and away from cylindrical body 106. In some cases, the convex circular platform can extend above a top surface of the water closet flange 103.

Next, referring between FIGS. 1A and 1B, a description of the operation of the illustrated water closet assemblies 100*a*, 100*b* (collectively "water closet assembly 100"), the removable caps 102*a*, 102*b* (collectively "removable cap 102"), and their various components is provided. As one non-limiting example, the water closet assembly 100*a* is connected to a drainage pipe below a floor. In some cases, the water closet flange 103 of the water closet assembly 100*a* is positioned above or flush with the floor. In other cases, the water closet flange 103 is recessed into the floor and rests on subflooring or some other suitable structure. Once connected to the drainage pipe, an individual can secure the water closet assembly 100 to the floor or subfloor by inserting fasteners into the perimeter apertures 107 and screwing the fasteners to the floor or subfloor. As discussed above, according to one aspect, the removable cap 102 is integrally molded to the annular shear wall 112. The removable cap 102 prevents small tools, debris, and other objects from accidentally failing into the drainage pipe. In addition, the removable cap 102 facilitates creating a seal at the end of the drainage pipe. Sealing the drainage pipe can enable the drainage system in a house to be pressure tested before mounting a toilet.

Figure 3A:
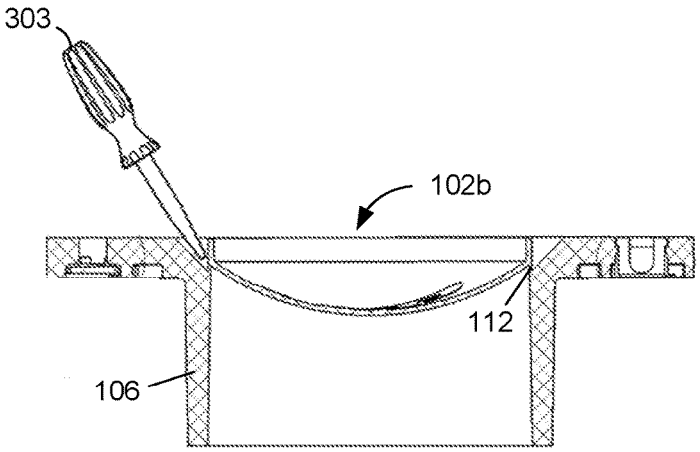
Figure 3B:
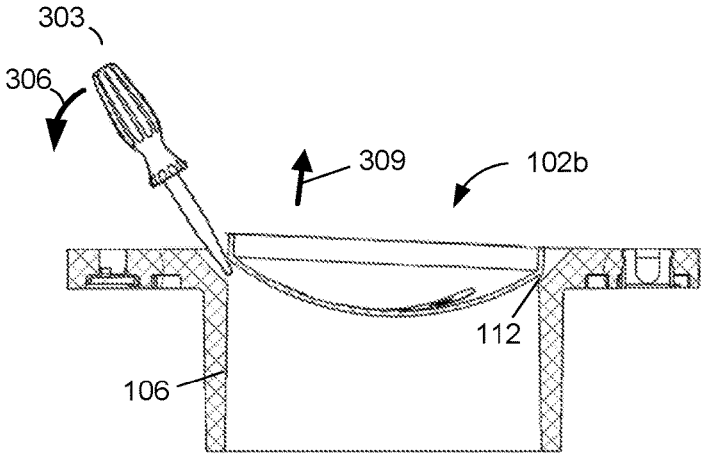

Before a toilet is installed, the removable cap 102 is separated from the water closet assembly 100. An individual can position a piercing end of the piercing instrument, such as the end of a flathead screwdriver, into the annular recess 115 and against the outer surface of the annular shear wall 112. The flathead screwdriver can be angled with respect to the longitudinal axis "L" such that the piercing end of the flathead screwdriver is oriented downward toward the cylindrical body 106 (FIG. 3A). The individual can then strike a handle end of the flathead screwdriver with a mallet or other instrument. The force from the strike will physically force the flathead screwdriver into and through the annular shear wall 112. Once the annular shear wall 112 has been punctured, the individual can use the flathead screwdriver to pry the removable cap 102 away from the water closet assembly 100, which causes the annular shear wall 112 to separate. Specifically, in some cases, the handle end of the flathead screwdriver is pivoted toward the water closet flange 103 or in other cases, the handle end of the flathead screwdriver is pivoted away from the water closet flange 103" (FIG. 3B). During this pivoting motion, the flathead screwdriver can be pivoted with respect to a bottom surface of the annular recess 115 and against other portions of the water closet assembly 100. This pivoting motion can create a leverage force that tears the remaining portions of the removable cap 102 off of the end of the annular shear wall 112. In other cases, properly penetrating the annular shear wall 112 with a hard strike from the piercing instrument pops the removable cap 102 off of the annular shear wall 112 without using a pivoting action as discussed above.

Figure 2A:
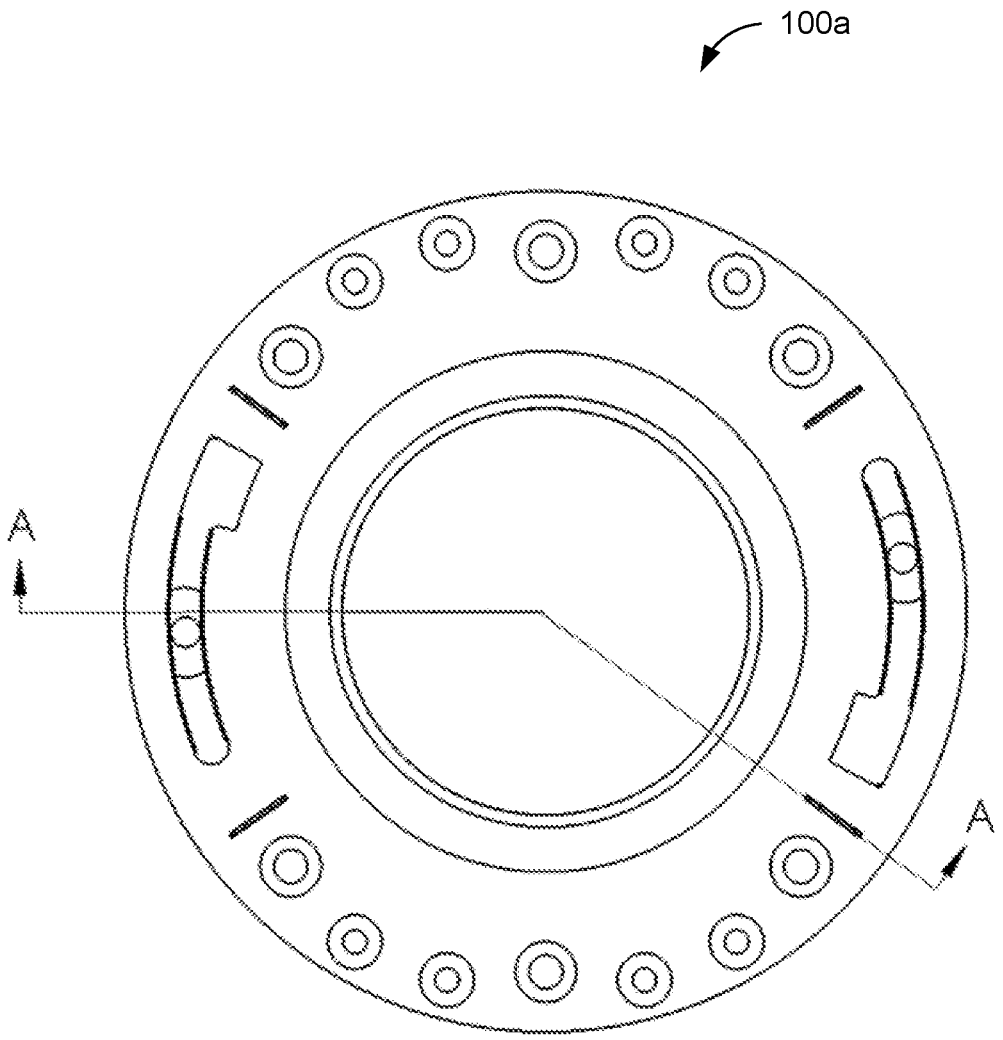
FIG. 2A is a drawing of a top side view of the water closet assembly from FIG. 1A according to various embodiments of the present disclosure.
Figure 2B:
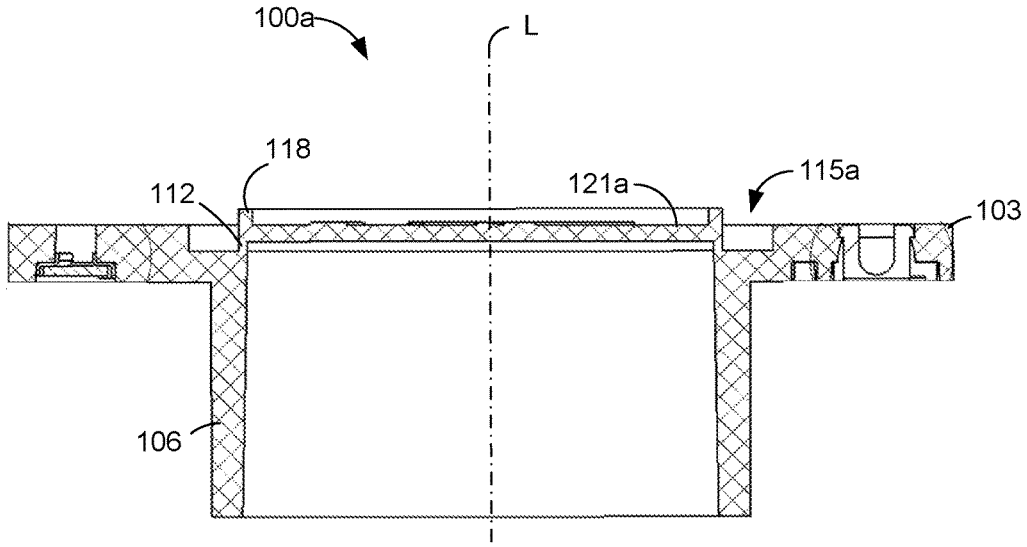
FIG. 2B is a drawing of a cross sectional view of the water closet assembly from FIG. 1A according to various embodiments of the present disclosure.

Turning to FIG. 2A, shown is a top side view of the water closet assembly 100. The illustrated embodiment displays a cross sectional "AA" reference for FIGS. 2B, 2C, and 2D. FIG. 2B illustrates a cross sectional view of the water closet assembly 100*a* from FIG. 1A with respect to the "AA" reference in FIG. 2A. In particular, FIG. 2B illustrates the annular shear wall 112 extending from the water closet assembly 100*a* in a direction along the longitudinal axis "L." In other embodiments, the annular shear wall 112 can extend at an angle with respect to the longitudinal axis "L." For example, the annular shear wall 112 can extend outwardly at angle from a lower portion of the annular shear wall 112, which can be substantially near a bottom surface of the annular recess 115*a*. Accordingly, the lower portion of the annular shear wall 112 has an outer diameter that is less than an outer diameter of a higher portion of the annular shear wall 112. In other words, the annular shear wall 112 can be shaped similar to a truncated cone or a funnel, and the removable cap 102 is molded to the higher portion of the annular shear wall 112. In other cases, the annular shear wall 112 can extend inwardly so that the lower portion of the annular shear wall 112 has an outer diameter that is greater than an outer diameter of a higher portion of the annular shear wall 112. In the illustrated embodiment, the end of the annular shear wall 112 is molded to the circular platform 121*a* and the raised ring 118. Further, the circular platform 121*a* has a substantially level surface. In one embodiment, the circular platform 121*a* is positioned above a bottom surface of the annular recess 115*a*.

In some cases, the water closet assembly 100*a* can be manufactured as one piece. In other words, the cylindrical body 106, the water closet flange 103, the annular shear wall 112, the circular platform 121*a*, and the raised ring 118 can be manufactured as a single piece.

Figure 2C:
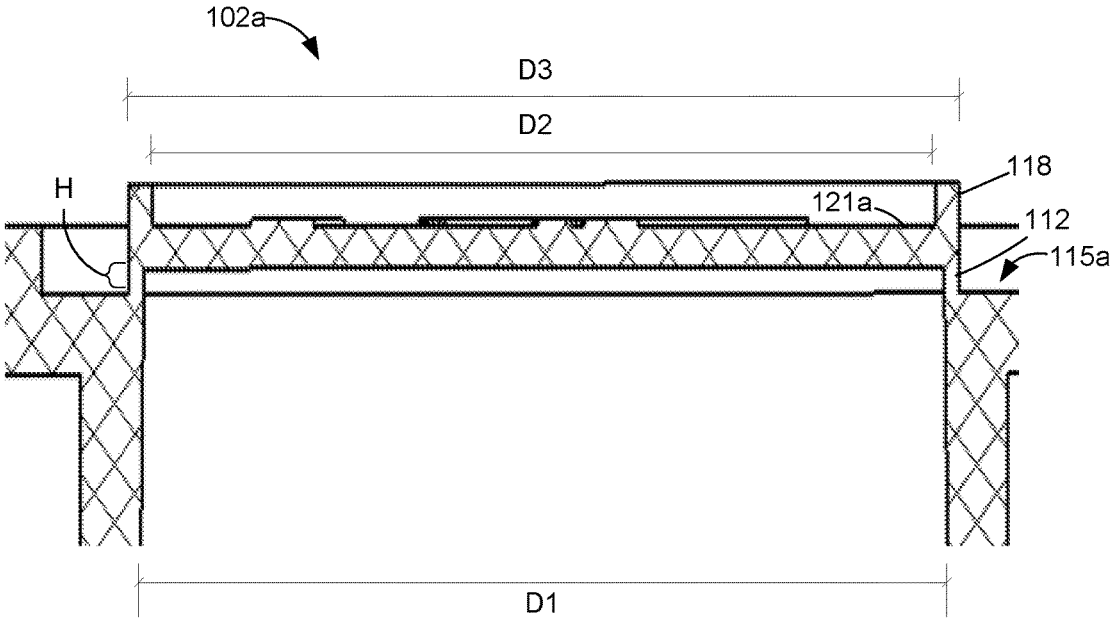
FIG. 2C is a drawing of an enlarged view of the cross sectional view depicted in FIG. 2B according to various embodiments of the present disclosure.

FIG. 2C illustrates an enlarged view of the cross sectional view depicted in FIG. 2B. Particularly, FIG. 2C illustrates that the annular shear wall 112 is positioned below the circular platform 121. A height "H" of the annular shear wall 112 along the longitudinal axis "L" or other direction can be from a bottom surface of the annular recess 115*a* to the circular platform 121*a*. This height "H" provides space for a piercing instrument to puncture the annular shear wall 112. In one embodiment, the annular shear wall 112 has a thickness that is less than a thickness of the cylindrical body 106. In addition, a diameter of an inner surface of the annular shear wall 112 substantially corresponds to a diameter of an inner surface of the cylindrical body 106, which is indicated as "D1" in FIG. 2C. That is to say, the inner surface of the annular shear wall 112 is vertically aligned with the inner surface of the cylindrical body 106 along the longitudinal axis "L" of the cylindrical body 106. Further, as illustrated in FIG. 2C, a diameter of the inner surface of the raised ring 118, which is indicated as "D2", is less than the diameter "D1" associated with the inner surface of the annular shear wall 112. Accordingly, in one embodiment, a thickness of the raised ring 118 is larger than a thickness of the annular shear wall 112. Further, a diameter of the outer surface of the raised ring 118, which is indicated as "D3", is greater than the diameter "D1" of the inner surface of the cylindrical body 106 and the diameter "D2" of the inner surface of the raised ring 118. As a result, the removable cap 102*a* cannot fall through the water closet assembly 100*a* and into the drainage pipe when removed.

Figure 2D:
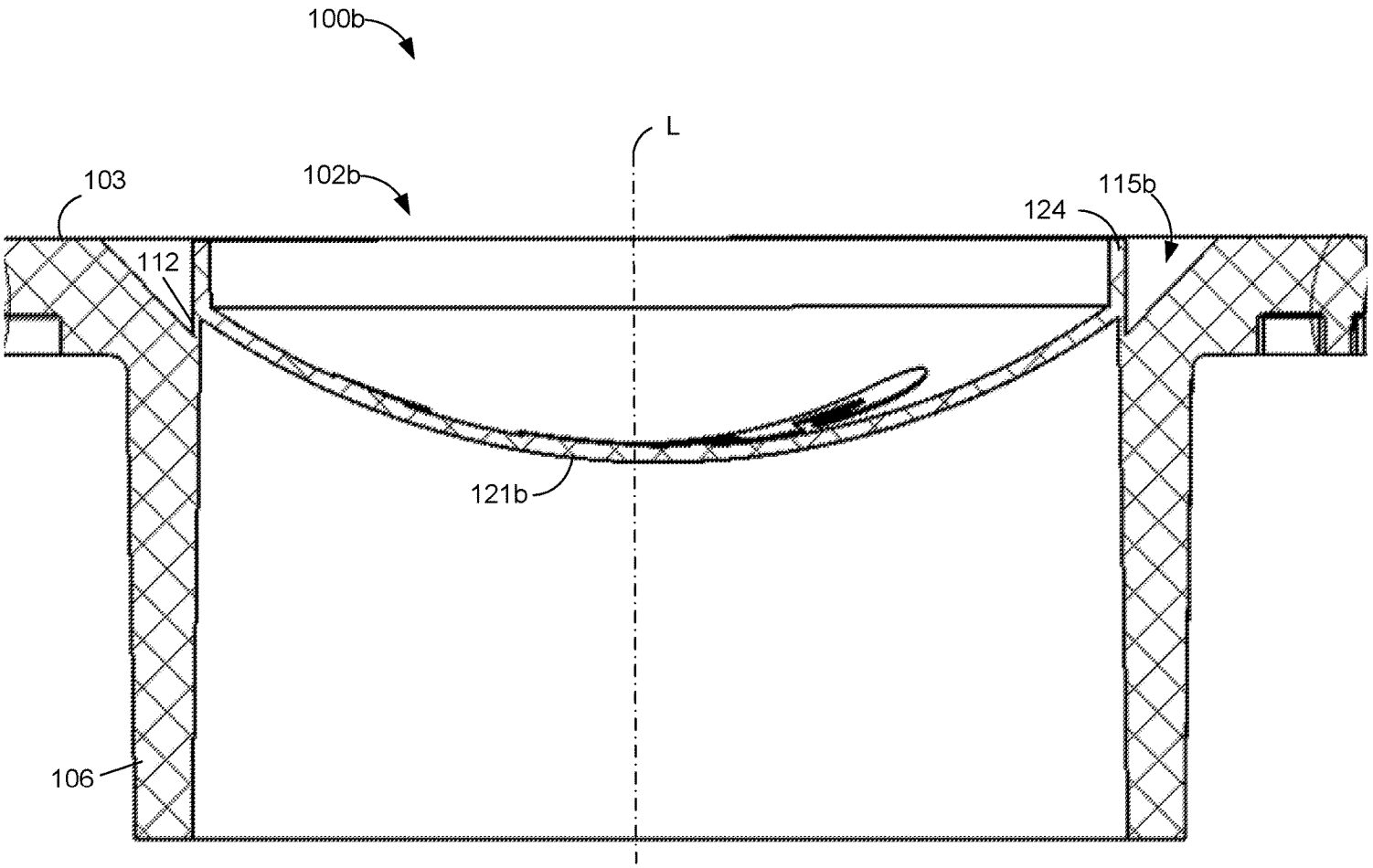
FIG. 2D is a cross sectional view of the water closet assembly from FIG. 1B according to various embodiments of the present disclosure.

Moving on to FIG. 2D, shown is a cross sectional view of the water closet assembly 100*b* from FIG. 1B. Specifically, FIG. 2D illustrates that the circular platform 121*b* has a concave surface, where the circular platform 121*b* curves away from the circular wall 124 and down into the cylindrical body 106. In other words, a portion of the circular platform 121*b* extends below the annular shear wall 112 and a bottom portion of the water closet flange 103 along the longitudinal axis "L" of the cylindrical body 106. In addition, a top surface of the circular wall 124 is substantially level with a top surface of the water closet flange 103. Accordingly, the illustrated embodiment of the removable cap 102 is less likely to be bumped or kicked accidentally by objects and/or individuals that are near or on the water closet assembly 100*b*. In another embodiment, the circular wall 124 can be positioned below the top surface of the water closet flange 103. In still another embodiment, the circular wall 124 may be positioned above the top surface of the water closet flange, although such an arrangement might make the removable cap 102 more susceptible to being bumped and damaged.

In addition, the water closet assembly 100*b* has an annular recess 115*b* with a different shape from the previous embodiment. Particularly, the annular recess 115*b* has a bottom surface with a slope angled toward the annular shear wall 112. That is to say, a lower portion of the slope ends at the annular shear wall 112 and a higher portion of the slope begins at the top surface of the water closet flange 103. The slope of the bottom surface can facilitate guiding the piercing instrument at an appropriate angle for penetrating the annular shear wall 112. For example, a piercing end of the piercing instrument can slide along the bottom surface of the annular recess 115*b*. This contact can assist an individual to use the proper angle before attempting to penetrate the annular shear wall 112 and the slope can serve as a brace to hold the proper angle when a mallet or some other object is used to strike the piercing instrument.

In another embodiment, the circular platform 121*b* has a convex surface, so that a portion of the convex surface extends above the circular wall 124. In some cases, the convex surface can extend above the top surface of the water closet flange 103. To the extent that the circular platform 121*b* is a concave or convex surface, the circular platform 121*b* is stronger and able to withstand greater pressure during pressure testing of the drainage system.

Figure 3C:
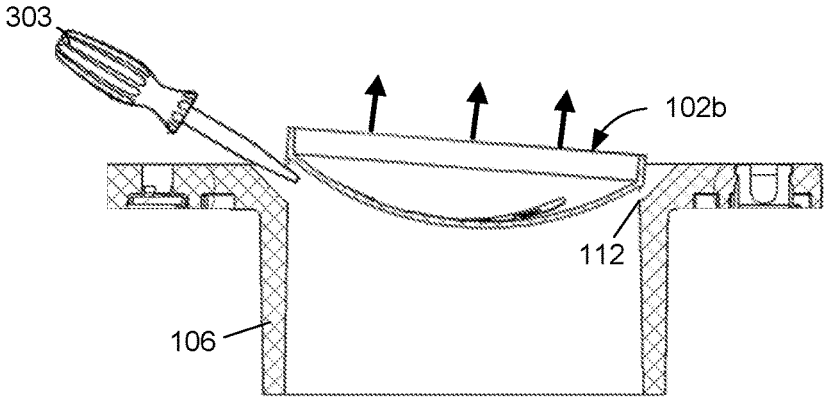

Turning now to FIGS. 3A-3C, shown is an exemplary progression of steps for separating the removable cap 102*b* from the water closet assembly 100*b*. Particularly, in FIG. 3A, a piercing instrument 303 can be positioned against the outer surface of the annular shear wall 112. The piercing instrument 303 may include, for example, a piercing end and a handle end. In the illustrated embodiment, the piercing instrument 303 is angled with respect to the longitudinal axis "L" such that the piercing end of the piercing instrument 303 is pointed below the circular platform 121*b*. After being positioned against the outer surface of the annular shear wall 112, the piercing instrument 303 pierces through a portion of the annular shear wall 112. There are various methods and tools that can be used to penetrate the annular shear wall. As a non-limiting example, an individual can position the piercing end of a flathead screwdriver against the outer surface of the annular shear wall 112. Then, one may use a mallet to strike the handle end of the flathead screwdriver, thereby forcing the piercing end of the flathead screwdriver (or other piercing instrument) toward the annular shear wall 112. The force from the strike can physically drive the flathead screwdriver into and through the annular shear wall 112. The amount of force needed to penetrate the annular shear wall 112 can depend on the thickness of the annular shear wall 112 and the material composition of the annular shear wall 112. In some embodiments, the individual may be able to penetrate the annular shear wall 112 by manually forcing the flathead screwdriver through the annular shear wall 112 without using the mallet.

FIG. 3B illustrates that the annular shear wall 112 has been penetrated. The individual can then pry the removable cap 102*b* upward, thereby separating the removable cap 102*b* off of the annular shear wall by pivoting the handle end of the piercing instrument 303 with respect to a bottom portion of the annular recess 115*b*. The piercing instrument 303 can be pivoted in a direction toward the water closet flange 103, as indicated by the arrow 306. In this manner, the piercing instrument 303 is used as a lever to force the removable cap 102*b* to break away from the annular shear wall 112. That is to say, a portion of the removable 102*b* can begin to separate from the annular shear wall 112 and move in a direction away from the cylindrical body 106, as indicated by arrow 309. FIG. 3C illustrates the removable cap 102*b* torn from the entire area of the annular shear wall 112 as the piercing instrument 303 is used to pry the removable cap 102*b* upward. In some cases, properly penetrating the annular shear wall 112 with the piercing instrument 303 pops the removable cap 102 off of the annular shear wall 112 without pivoting the piercing instrument 303.

In some cases, pliers may be used to facilitate separating the removable cap 102*b* from the annular shear wall 112. For instance, an individual can use the pliers to grip the circular wall 124 and pull the circular wall 124 in a direction away from the water closet flange 103 after a portion of the annular shear wall 112 has been penetrated. In other cases, pliers can remove the removable cap 102*b* without penetrating the annular shear wall 112.

Disjunctive language such as the phrase "at least one of X, Y, or Z," unless specifically stated otherwise, is otherwise understood with the context as used in general to present that an item, term, etc., may be either X, Y, or Z, or any combination thereof (e.g., X, Y, and/or Z). Thus, such disjunctive language is not generally intended to, and should not, imply that certain embodiments require at least one of X, at least one of Y, or at least one of Z to each be present.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

Therefore, the following is claimed:

1. An apparatus, comprising:

a water closet assembly having a cylindrical body and a water closet flange;

an annular shear wall that extends from the water closet assembly, the annular shear wall comprising a first inner surface that aligns with a second inner surface of the cylindrical body;

the water closet assembly including an annular recess;

a wall of the annular recess including a first outer surface of the annular shear wall; and a removable cap extending from the annular shear wall, wherein a second outer surface of the removable cap is in alignment with the first outer surface of the annular shear wall.

2. The apparatus of claim 1, wherein the annular recess permits access for a piercing instrument to puncture the annular shear wall.

3. The apparatus of claim 1, wherein the removable cap is configured for pressure testing a drainage system prior to an installation of a toilet.

4. The apparatus of claim 1, wherein a first diameter of the first inner surface of the annular shear wall substantially corresponds to a second diameter of the second inner surface of the cylindrical body.

5. The apparatus of claim 1, wherein a first thickness of the annular shear wall is less than a second thickness of the cylindrical body.

6. The apparatus of claim 1, wherein the removable cap comprises a concave surface that is curved away from the water closet flange along a longitudinal axis of the cylindrical body.

7. The apparatus of claim 1, wherein the removable cap comprises an annular ring.

8. The apparatus of claim 1, wherein the removable cap comprises a concave surface that extends from a top portion of the annular shear wall to below the water closet flange along a longitudinal axis of the cylindrical body.

9. A method of removing a test cap from a water closet assembly, comprising:

positioning a piercing instrument against an annular shear wall of a water closet assembly, the water closet assembly comprising a cylindrical body and a water closet flange, the annular shear wall extending from the water closet flange in a direction of a longitudinal axis of the cylindrical body, the annular shear wall being attached to a test cap, a first outer surface of the annular shear wall having a diameter that corresponds with a second outer surface of the test cap, the annular shear wall comprising a first inner surface that aligns with a second inner surface of the cylindrical body;

inserting the piercing instrument through a portion of the annular shear wall; and prying the test cap away from the water closet assembly, causing the annular shear wall to separate.

10. The method of claim 9, wherein a remaining portion of the annular shear wall tears off of the annular shear wall in response to a leverage force created by the prying of the piercing instrument.

11. The method of claim 9, wherein the test cap further comprises a raised ring along a perimeter of the test cap.

12. The method of claim 11, wherein the test cap further comprises a concave surface, wherein a portion of the concave surface extends below the water closet flange along the longitudinal axis of the cylindrical body.

13. The method of claim 9, wherein the water closet assembly comprises an annular recess channel that surrounds the annular shear wall.

14. The method of claim 13, wherein the annular recess channel is formed with a portion of the annular shear wall.

15. The method of claim 14, wherein the annular recess channel comprises a bottom surface having a slope, the slope having a lower portion connected to the annular shear wall.

16. A device, comprising:

a water closet assembly having a cylindrical body and a water closet flange;

an annular shear wall that extends from the water closet assembly in a direction of a longitudinal axis of the cylindrical body, wherein a first inner surface of the annular shear wall and a second inner surface of the cylindrical body form a continuous aligned surface;

the water closet assembly comprising an annular recess;

a wall of the annular recess including an outer surface of the annular shear wall; and a removable cap extending from the annular shear wall, wherein the removable cap is configured to be removed from the annular shear wall by inserting a piercing instrument through the annular shear wall and using the piercing instrument to pry the removable cap away from the water closet assembly, causing the annular shear wall to separate.

17. The device of claim 16, wherein a bottom surface of the annular recess is positioned lower than a circular surface of the removable cap.

18. The device of claim 16, wherein the removable cap comprises a ring positioned along a perimeter of the removable cap.

19. The device of claim 16, wherein the water closet flange, the annular shear wall, the cylindrical body, and the removable cap are one piece.

20. The device of claim 16, wherein a first thickness of the annular shear wall is less than a second thickness of the cylindrical body.

* * * * *